US005727787A

United States Patent [19]

Salley

[11] Patent Number: 5,727,787

[45] Date of Patent: Mar. 17, 1998

[54] ADAPTIVE GAME BOARD PROVIDING MULTIPLE GAME PATHS

[76] Inventor: Sybil Salley, P.O. Box 452, Magnolia, Tex. 77362

[21] Appl. No.: 688,011

[22] Filed: Jul. 26, 1996

[51] Int. Cl.[6] ..... A63F 3/00

[52] U.S. Cl. ..... 273/284; 273/287; 273/141 R

[58] Field of Search ..... 446/147; 273/243, 273/249, 259, 281, 284, 141 R, 287; 40/446, 489, 490, 491, 618

[56] References Cited

U.S. PATENT DOCUMENTS

| | | | |
|---|---|---|---|
| 1,155,523 | 10/1915 | Smith | 40/489 |
| 2,105,563 | 1/1938 | Thomas | 273/284 |
| 2,889,036 | 6/1959 | Davies | 40/489 |
| 5,250,000 | 10/1993 | Boutin et al. | 273/284 |
| 5,338,041 | 8/1994 | Jones et al. | 273/284 |
| 5,356,155 | 10/1994 | Gross | 273/284 |
| 5,566,945 | 10/1996 | Saguclo | 273/284 |

*Primary Examiner*—William M. Pierce
*Attorney, Agent, or Firm*—Gunn & Associates, P.C.

[57] ABSTRACT

This disclosure is directed to a game board, one embodiment incorporating a carrying case which encloses a stack of inserts. While the inserts appear differently, they all provide game playing paths thereon to simulate running, swimming and other sporting events. Moreover, a typical insert has top and bottom faces which present different images thereon. Each is formed of a laminate presenting upper or lower images, and there is a magnetically attracted layer therein to enable a talisman having a magnet in the base to move thereon in accordance with the rules of play. A convenient carrying case is incorporated with storage compartments for the various markers and other equipment as well as for a stack of the images. A CD ROM software package is likewise included.

23 Claims, 3 Drawing Sheets

FIG. 1
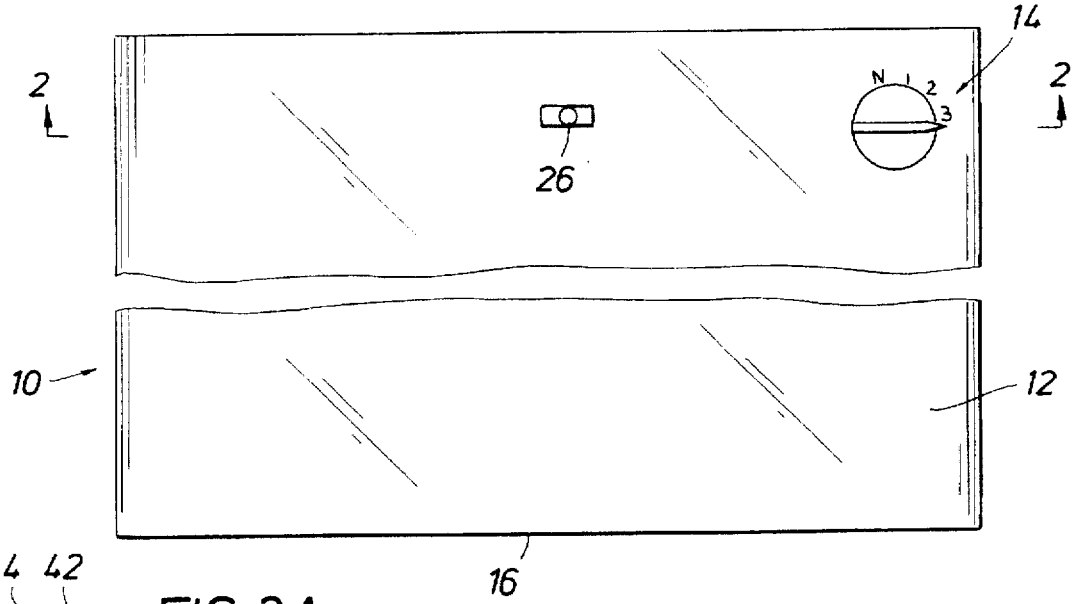
FIG. 2A
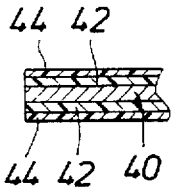
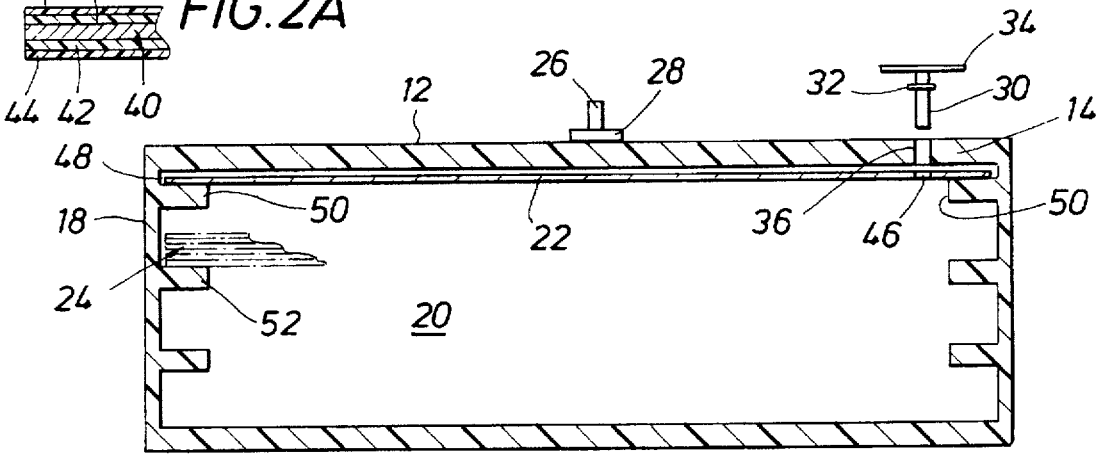
FIG. 2
FIG. 3
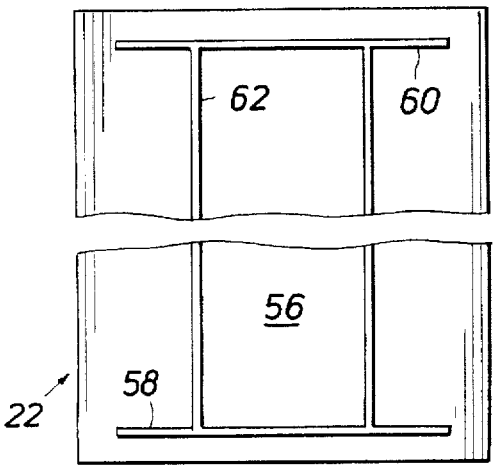
FIG. 4
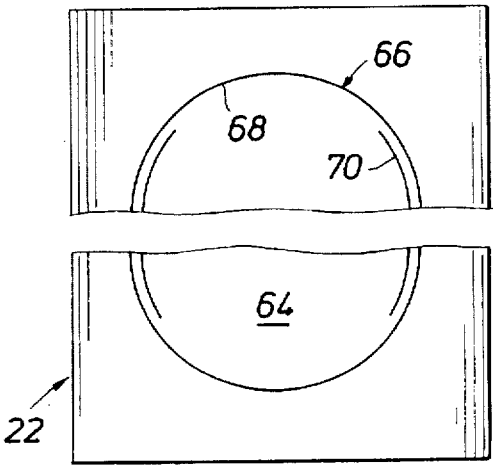

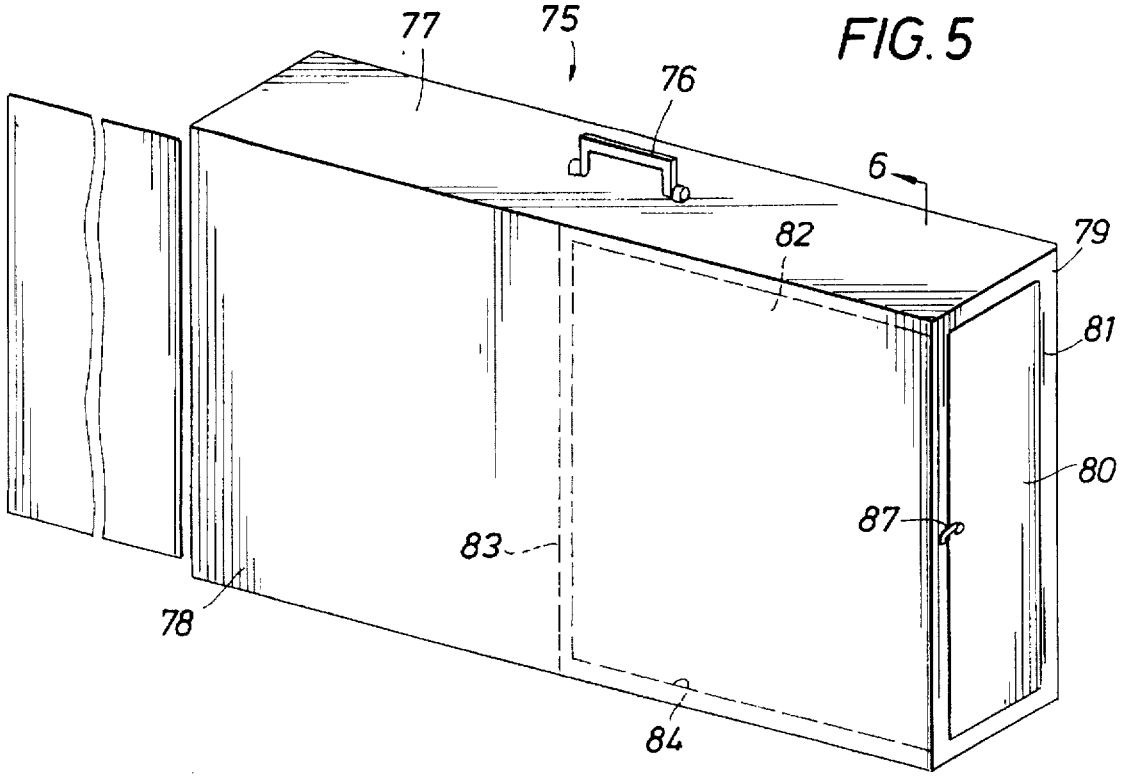
FIG. 5
FIG. 8
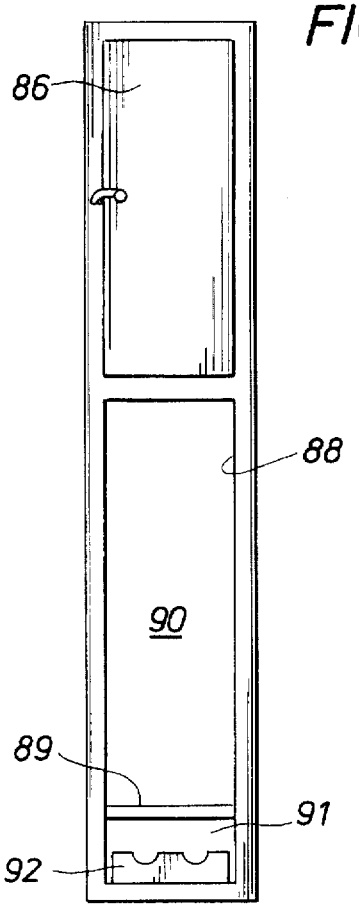
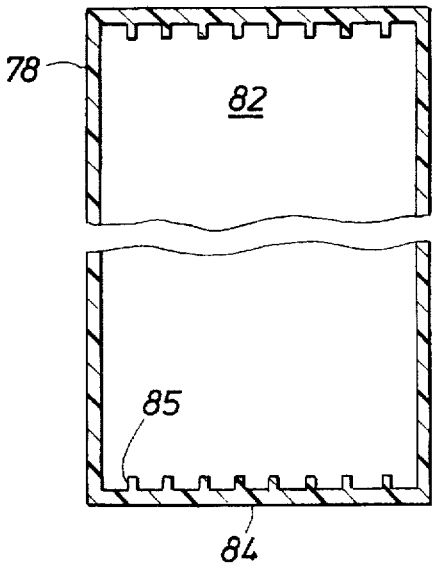
FIG. 6
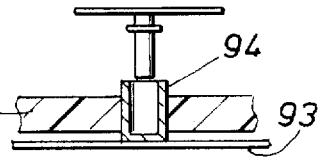
FIG. 7

ADAPTIVE GAME BOARD PROVIDING MULTIPLE GAME PATHS

BACKGROUND OF THE DISCLOSURE

The present disclosure is directed to a game board which has an adaptive back drop. Through the use of convertible back drops, a number of paths can be provided. The paths are used to enable two or more contestants to engage in a contest of sport or amusement using the game board.

Most game boards have a fixed game playing path on them. It is not uncommon for the path to be a border located path where two or more contestants move some sort of marker. Such markers will be referred to hereinafter as a talisman. A talisman in the present disclosure is particularly located on a game playing path which enables two or more contestants to engage in a game (for a rainy day) during which the contestants are able to change the back drop and thereby obtain a large number of relatively brief and somewhat different games.

This disclosure describes alternate embodiments for playing the same game. The embodiments differ primarily in the support carrier or cabinet for the game. In one version, it is constructed in the form of a small brief case or handle supported cabinet. It is relatively thin and has the appearance of a briefcase which can be secured out of harms way when desired and which can be retrieved by a participant. In this version, it is especially adapted for use by youngsters, typically in the range of about 8 years to 12 years. In another aspect, a different version is set forth which provides a number of inserts which are used with a carrying case of transparent construction. In both instances, the cabinet or other type of carrying case encloses a number of game faces or images as will be described. While a package can be provided which has a minimum number of game boards, it is normally intended that a large number of game playing surfaces be provided. Again, those terms will be defined herein below so that the participants see an image which depicts or mimics one or several different types of sporting events. One good model is the mix of events in the Olympics which includes a large number of men's track and field events. Women's events are also separately depicted. In addition, there are other types of events, including swimming, weight lifting, wrestling, and so on.

One form of the present disclosure sets forth a game board which is therefore able to change "faces" referring to the appearance of the game board. It is able to change its appearance quickly and readily. In one aspect, the appearance is dominated by the choice of an image which can be mounted as a movable insert. The image is part of the game in an effective manner. As an example, the image may readily set forth a multi lane track in the form of an oval for running events of the sort which occur in the Olympics. The oval is typical of the track utilized in a large number of running events. By comparison, another image may present only a portion of the track, namely, the straight or linear portion used in the short sprints. While portions of the track are mentioned for the images just noted, the context can be shifted to swimming events in the Olympics by depicting a racing pool. The game is enhanced by the incorporation of such an image. Typically, the images are provided with a multitude of parallel lanes. Again in the examples just given, both the oval tracks and a racing pool define the paths in which a number of contestants typically undertake the race. The optimum for this is at least two and preferably eight racing paths. This enables up to eight contestants to use the game of the present disclosure. It also enables only two to use the game so they can contest between themselves. The eight contestants are typically marked with a talisman placed on the surface. The talisman is moved on the game board with respect to the image presented. This enables the several contestants to move their respective talisman along confined paths. The confined paths enable one or more contestants to direct their talisman along the paths in accordance with a random number generator which is used to provide the respective moves. During game play, the moves are made by advancing the respective markers.

As noted above, the image that is seen by the player is an important aspect of the present game system. In an alternate embodiment, images are provided on an exposed phase of a removable insert. The insert is a double sided game board. It is positioned on a table or other surface so that players can use that surface. Moreover, the surface where the image is seen is constructed in a laminated sheet construction. More will be noted regarding that sheet below.

The marker is preferably constructed with a magnet in the base. It is positioned on a clear plastic case or cabinet which has an exposed upper face. The face, and the extent thereof, is sufficient to support up to M markers of the several contestants. In this alternate form, they are preferably held in position by magnetic coupling to the board game cabinet. To accomplish this and yet provide the image that is helpful in presenting the game for the contestants, the cabinet is formed with a clear plastic top face. There is room just under the top face for insertion of an opaque backing member. The member is opaque, preferably providing, on top and bottom sides, different images. One or the other image is selected to be seen through the clear cabinet. This removable insert is mounted in the cabinet by sliding the insert into a slot sized to receive the insert. It is positioned quite close to the transparent top so that the image can be seen. Moreover, it is preferably made with a ferrous material in it to assure a support for the markers which are constructed with magnets in the base so that the markers stay in position and are held upright. Through this approach, the removable insert enables the game players to select the image, and the image selected then defines the nature or shape of the game playing path on the surface. That can be changed from image to image. In turn, that changes the mode of play.

In one aspect of the present disclosure, a small carrying case or cabinet or briefcase supports a stack of the inserts. In a construction to be discussed, the carrying case is constructed with a handle along one edge. The handle is easily gripped by hand. The cabinet is closed with a stack or set of inserts in the cabinet. This is located in a first storage compartment. In an alternate embodiment, the disclosure sets forth upper and lower storage compartments. This enables the small case or cabinet to enclose first and second sets of inserts. If need be, it can be constructed with a storage chamber for a first set of inserts and a second storage chamber of like construction for a second set of inserts. If need be, it can be replicated so that there are two at each end, providing a total of four storage compartments. One compartment is optimally included to serve as a storage chamber for small pieces of the game. This is where markers and talisman are located. They are positioned in this storage compartment. Again, the several storage compartments are preferably closed by means of individual doors which latch over the storage compartments. The doors are provided with hinges along one side and a latch on another side to latch the doors shut.

With regard to the cabinet, it is constructed with internal slots to receive a number of inserts. The inserts are positioned so that they can be placed in the cabinet or housing.

They are also placed in the cabinet or housing for storage. A single game is therefore readily converted into a large number of games depending on the number of inserts. Conveniently, each insert is provided with top and bottom images.

An attractive version of the present disclosure is provided in a handle equipped cabinet. On the interior, it has one or more compartments which function as storage compartments for a plurality of inserts. The game is played on one of the inserts which is positioned with an exposed space. A separate spinner construction is mounted on that particular insert.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 1 is a plan view of the game board of the present disclosure showing the top face, a marker thereon, and a spinner enabling the random number generation for game play;

FIG. 2 is a sectional view along the line 2—2 in FIG. 1 in which the depth of the equipment has been exaggerated to enhance a description of the structure and further showing how individual inserts are stored and removed to change the image during play;

FIG. 2A is an enlarged view of an insert;

FIGS. 3 and 4 are similar inserts which present different game play images when placed in the board game illustrated in FIG. 2;

FIG. 5 is an isometric view of a briefcase cabinet or carrying case for plurality of games on the respective inserts which are mounted in the valise or briefcase of FIG. 5;

FIG. 6 is a sectional view along the line 6—6 of FIG. 5 showing the shape of the internal storage compartment;

FIG. 7 is a detailed enlargement of an alternate spinner construction;

FIG. 8 is an alternate edge view of the storage cabinet of the carrying case shown in FIG. 6 of the drawings which shows upper and lower storage compartments;

DETAILED DESCRIPTION OF THE PREFERRED EMBODIMENT

Figure 9:
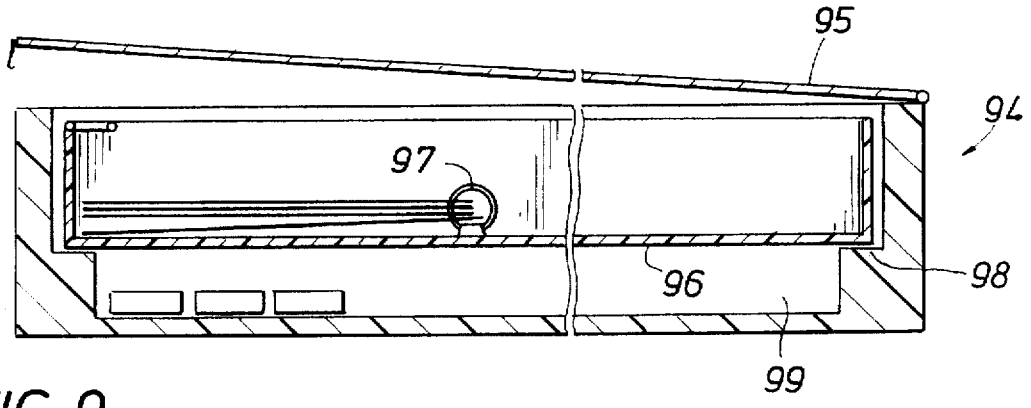
FIG. 9 is an alternate embodiment of a cabinet.

The present disclosure will discuss several alternate views set forth in the drawings. These several views describe details of different embodiments. In setting out the mode of the game and its play, the sequence of play will be correlated to the images (that term is defined below) on which the game play occurs. The several games are played over a time interval by the user or several users. This can be done with first one game image and then the next game image. To this end, the present disclosure contemplates storage of a large number of inserts. Each insert is imprinted with a game scenario on each of the two planar faces of the game inserts. As will be described beginning with FIG. 1 on the drawings, the board game is set forth in the context of a clear transparent cabinet or housing. This permits the cabinet to be involved in the game itself. In an alternate version, the cabinet is more aptly a carrying case and is less involved in the play of the game. This distinction will be expanded during the discussion below.

Attention is now directed to FIG. 1 of the drawings where the numeral 10 identifies the board game of the present disclosure. It is shown illustrating the top face which will be denoted by the numeral 12 and is formed of a clear transparent material. The top face is a simple rectangular or square plane. In one corner, a random number generator 14 is incorporated. It cooperates with a set of numbers which are printed on an insert to be described and which is visible through the top. Considering the game board 10 is greater detail, it is shown in FIG. 2 which depicts the top surface 12 as a region constructed with transparent material to be able to see the insert below the top surface 12. As shown in FIG. 2, the interior is hollow and is constructed so that several inserts can be placed in it. In that sense, it defines a storage cabinet or container. This cabinet or container is provided so that several inserts are stored in the cabinet or container. That aspect will be explained along with the mechanism for selecting and presenting a single image.

Returning now momentarily to FIG. 1 of the drawings, the game board 10 is constructed with vertical walls on three sides so that it is open on one side. The side 16 as illustrated in FIG. 1 is selected to be the open side. The other three sides are closed by the side walls. One such side wall is shown at 18 in FIG. 2. Similar side walls enclose the storage compartment 20 on the interior. The storage compartment is provided for a number of inserts. One such insert is shown at 22. It is a composite of several layers of material which have been enlarged in FIG. 2A and which will be described in some detail hereinafter. For the moment, it is appropriate to note that several inserts 20 are included in FIG. 2. A large number are stacked and stored at 24. As a generalization, they comprise an inventory presenting different images for use of the board game 10.

As noted, the game is played with a marker or talisman, and an example is shown at 26. It is constructed with a base 28 having a magnet in the base. The magnet couples through the top face 12 and is therefore held with a better grip on the surface. Accidental movement of the marker 26 is reduced by use of the magnet in the base. Ferrous material enabling the magnet to be held more firmly is located below the top face 12 as will be described.

The top face includes an area for the random number generator. In the preferred form it is a simple spinner. Conveniently, it can be constructed with a removable post 30 and a ring 32 mounted on the post. The pointer 34 is rotated on the post 30 to indicate a number generated in a random fashion. The number is some number in a set of numbers N which determines the move or play of the contestants. The post 30 fits slightly loosely in a drilled hole 36 formed in the clear plastic top face 12. It can be demounted and then reinstalled. It simply lifts out and reinserts into the hole 36. This is done so that the spinner can insert into a matching hole for alignment purposes in one of the inserts which is selected.

The insert 22 is provided with a matching hole which aligns with the hole 36 so that the spinner is then registered at the center of a set of numbers. The numbers range from one to N and are printed on the exposed top face of the insert 22. This planar sheet of the insert is constructed of several laminated layers as better illustrated in FIG. 2A of the drawings. This enlarged view shows a central layer of ferrous material at 40. This provides weight, stiffening, and a magnetic coupling with the markers to hold the markers in place. FIG. 2A shows in the exaggerated thickness the image layer 42. Both top and bottom are provided with image layers 42. The outermost layer is a protective laminate layer 44 which is incorporated on the top and bottom. This is preferably waterproof and scratch proof. It is impervious so that it will provide long life for the respective images. The particular image is formed in the layers 42. There are two such layers and therefore there are two such images per insert. Because the insert is symmetrical, it can be inverted to present one or the other. For each image, the insert 22 is preferably provided with a perforation 46 in the appropriate location to align with the shaft 30 on the spinner.

As illustrated in FIG. 2, a single insert is selected and positioned immediately adjacent to the top face. This is secured in location by a slot 48. The slot 48 is defined by an inwardly protruding shoulder 50. The shoulder is matched on both sides. The storage chamber 20 thus can hold or store multiple inserts. The slot 48 is relatively thin, but it is preferably constructed with an adequate height to enable one or two inserts to be placed in the slot 48. In the illustrated version, the positioning of two or three of the inserts 22 in the slot 48 provides a measure of stiffening so that the slots 48 hold the inserts snugly against the top face 12. This prevents drooping or sagging of the inserts. Indeed, the shoulder 50 can be extended further toward the interior to increase bottom support for the inserts.

The game 10 is preferably sold with a large number of inserts. Several are stored on the shelf 52 as illustrated. Additional shoulders can be incorporated and additional storage slots are thereby defined comparable to the slot 48. The difference however is that the slot 48 locates the one selected for immediate use. Those not in use are stored in a parallel fashion in the storage chamber 20.

A large number of the inserts 22 are constructed and arranged in a similar fashion and yet are provided with altogether different images. Recalling that there are two images per insert, if the game 10 is provided with ten inserts, this provides a total of twenty images. Comparable to the Olympics, this number can be increased markedly so that the number of inserts 22 can be on the order of fifty to provide one hundred different types of games. In that aspect, each insert is structurally like the other inserts and they differ primarily in the presentation of the image placed thereon.

GAME CASE EQUIPPED WITH STORAGE COMPARTMENTS

Attention is now directed to FIG. 5 of the drawings which shows an alternate embodiment 75. The embodiment 75 is a briefcase or carrying case equipped with a handle 76. It is typically formed of plastic material having a decorated surface. It is a relatively rigid structure. It functions as a cabinet or carrying case and has the appearance to a casual observer of a briefcase. It has dimensions on the interior to receive, store and support at least one insert; there are preferably at least two or more storage compartments.

The storage compartments are on the interior. The discussion will therefore will go over the exterior aspects of the structure and reference will then be made to the internal compartments. FIG. 5 therefore shows the carrying case with a top face 77 which is opaque, and a front face 78 which is similar opaque material. This defines a generally rectangular structure which is relatively thin but stands relatively tall in terms of dimensions. The end 79 incorporates a hinged door 80 which is supported on one or more piano hinges 81. They swing the door open and closed as illustrated. On closure, a clasp 87 is locked to hold the door 80 in the closed condition. The closed door is constructed so that it provides controllable access to an end located storage compartment. The storage compartment 82 is located at the right hand end of the briefcase 75 while a similar storage is located at the left hand end. The storage compartment 82 is divided from the other portions on the interior by an internal transverse partition 83. The partition extends vertically along a center line across the briefcase 75. In addition to that there is a bottom surface which is defined by the bottom wall 84 shown in FIG. 5 of the drawings. The bottom wall 84 is below the level of the door 80 which opens to expose a storage compartment 82.

Going now to FIG. 6 of the drawings, this is an enlarged view of the storage compartment 82. FIG. 6 shows the side wall 78 and also shows in sectional view the bottom wall 84. There are several slots at 85 which are deployed along the top and bottom and which face each other with inwardly directed shoulders to guide inserts which are stored in the compartment 82. The number of inserts can be varied and hence the number of inwardly directed shoulders can be varied. The embodiment as shown in FIGS. 5 and 6 is able to store a specified number of the inserts in the compartment 82. There is a similar compartment at the opposite end as previously noted in this particular version which is constructed to have two storage compartments.

Attention is now directed to FIG. 8 of the drawings which shows another version of the briefcase 75. In this version, the briefcase stands taller and therefore has two storage compartments which are deployed top and bottom. The uppermost storage compartment is immediately behind the door 86. This door is also provided with a clasp and hinges so that it can open and close. In addition to that, there is a lower door opening below where the door has been removed to provide a view of the interior. The door opening 88 is open to reveal a transverse partition 89. This defines an insert compartment 90 above the partition 89 and separates a small storage compartment 91. The storage compartment 91 is underneath and is relatively narrow. It is constructed with a rectangular cross sectional area and can store the small pieces necessary for the game. The small pieces typically include several markers, the spinner previously noted, and also a support tray 92. Each player is preferably provided with a trough or tray 92 which receives, secures and holds markers which are won by the players. As will be discussed regarding the rules hereinafter, markers are awarded which correspond to achieving first, second, and third place in the races or other events. These would correspond to the award of a gold medal for victory. The nature and construction of the rewards can be varied widely, as desired.

Going now to a description of the briefcase shown in FIG. 8 of the drawings, it supports upper and lower stacks of removable inserts. Several inserts are slotted into the respective two storage chambers. There is a third storage chamber 91 as mentioned, and it is reserved for the small game playing pieces which might otherwise become lost. To this end, the door that closes the opening 88 is like the door 86 at the top part of FIG. 8 except the door is longer. Because it is longer, it closes over the upper storage compartment and the storage compartment in 91.

Attention is momentarily directed to FIG. 9 of the drawings which shows a carrying case 94 equipped with a lid or top 95 which rotates around an edge located hinge. The opposite edge is shown with a latch so that it locks in a closed state. The interior supports a tray 96 (equipped with retractable handles) which lifts out to hold the number of game playing images. In this particular instance, the images are held in place along a multiple ring latch which is similar to a three ring binder. The binder is anchored on a planar support. The binder has snap rings 97 which open and close to hold the inserts. The tray 96 is supported on a shoulder 98 to define a lower storage chamber 99. That is included to receive and store small pieces for the game when not in use. Moreover, the game can be played simply by dismounting the tray from the carrying case. The carrying case can be momentarily placed to the side. The various images required for play of the game are then presented. The various images make up individual removable inserts as previously defined. In this particular instance, they are stored, not by slotting, but by forming perforations along the edge so that they can be held in a multiple ring binder. As will be understood, the latch can hold a stack deployed to the left as illustrated and a comparable stack to the right. As shown further, the tray 96 lifts out to hold a large stack of such images. While the minimum is only a single image, and in reality two images because one is placed on the back, the norm is to provide a large stack of such images so that they can provide a simulation of a large number of sporting events including running events, swimming events, gymnastics and others.

The compartment 99 in the bottom is located below the tray 96 and is defined in height by the shoulder 98. That compartment 99 stores the necessary markers, talisman, simulated awards and the like. Gold, silver and bronze medals can be stored in this area. It is possible to segregate the markers, talisman and necessary equipment for a particular game to a particular image. For that, the necessary equipment for a particular game is preferably grouped in an isolated container. The talisman, and all related equipment for a selected image can be marked with a code number or symbol which ties to that particular image.

In operation, the embodiment of FIG. 9 is opened by raising the lid or cover 95. This enables the tray 96 to be lifted out. The tray can be placed on the table, and individual images can then be detached from it. As a convenience, they are kept together simply by fastening them together with the multiple ring latching device. Since they are constructed in the form of a sheet, they can be held in a stack as illustrated. Moreover, when they are lifted out, they expose the bottom storage compartment 99 with the smaller pieces. This is the location at which the talisman are stored.

Figure 10:
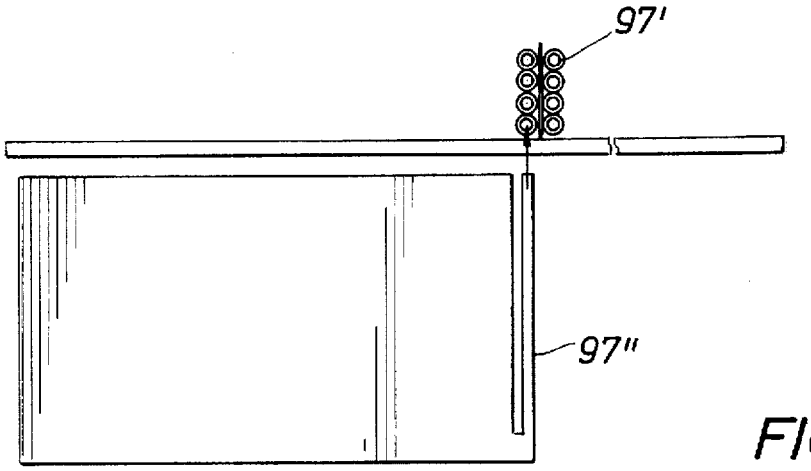
FIG. 10 is an alternate form of a cabinet.

FIG. 10 shows an alternate construction replacing the mechanical latch ring system 97 shown in FIG. 9. In this version of the equipment, the several separate planar game inserts are constructed with a simple, edge located slot matching the diameter of a set of joined tubes 97'. The tubes 97' are sized to receive the edge located alignment spline 97" shown in FIG. 10. The cut defining the spline does not go to the furthest edge. Each is stored simply by aligning the spline 97" so that the spline stabs into the provided tubes. Storage is conveniently achieved by pushing each spline into each tube, thereby storing one per tube. The tubes are joined on a planar support similar to the one shown in FIG. 9.

Attention is momentarily directed to FIG. 3 of the drawings where a single insert 22 is illustrated. Arbitrarily, it has been selected to provide an image for the one hundred meter dash. To this end, the image 56 on the top face depicts a starting line 58 for the hundred meter dash, a finish line 60, and specific lanes 62 for up to M contestants. The lanes 62 are preferably parallel, marked with equal calibrations, and are otherwise identical. This enables the contestants to compete evenly over comparable distances. The image 56 therefore presents the M lanes and each lane is defined with an equal number of game playing stations. That number is represented by the symbol K. Assume for easy definition that the one hundred meter dash is simulated with one hundred game playing positions along each path or lane 62. In that event, the spinner 14 is a random number generator providing an integer from one to N. The maximum might be ten to select an easy example. Through random chance, each contestant is provided with a number of turns to use the random number generator 14, spinning it and achieving some number up to N. The marker is advanced along the game playing path 62. When the marker has advanced to the finish line 60 shown in FIG. 3, that person has finished the race. With any number of contestants, game play can continue in this fashion indefinitely until there are winners. Accordingly, the insert 22 which presents the image 56 from FIG. 3 can be used for that type of event.

Attention is now directed to FIG. 4 of the drawings. It shows another insert 22. This insert is provided with an image 64 which shows an oval track 66. There is an outer lane 68 and an inside lane 70. Again, it is a game adapted for up to M contestants and each lane 68 or 70 is provided with K stations along the lanes. To be true to the Olympic events, the oval 66 is provided with eight or M lanes and the eight lanes are provided with K stations along each lane so that the lanes are equal in length to the contestants. As before, the random number generator is used to provide a random number which is an integer between one and N for each contestant. The random number generator comprises the spinner shown in FIG. 1. The numbers seen in a circle around the spinner are on the insert. A change of scale is suggested by shifting from the one hundred meter dash to the four hundred meter run. If there were no change of scale, the four hundred meter event would take much longer or a larger number of turns. With a change in scale, the maximum number N can be increased. The increase is correlated to the length of the track event so that play for this particular image 64 is approximately equal to that of the one hundred meter dash just exemplified.

In many track events, the event may have the form of a single effort such as a throw or jump. In throwing the shot or discus, length of the throw is the sole criteria. In that event, the random number generator 14 is preferably provided with a set of calibrations defining the measure of performance. In that sense, a single operation of the random number generator per contestant is all that is allotted. Alternatively, and depending on the rules of play and the speed of play, each contestant can be provided with more than one spin. If more than one, the number of spins may readily correspond to the number of attempts permitted during the contest. As an example, the broad jump normally entails six attempts.

Using the broad jump as an example, the game playing path can optionally be used. Referring back now to FIG. 3 of the drawings, the markers of the respective contestants can be advanced along the symbols 62 by a length or distance corresponding to the jump completed in earlier efforts. Each contestant can therefore position their marker along the path 62 corresponding to the length of jump for six jumps. This can provide a graphic representation of the contest as it actually occurs. Moreover, this type of play through six turns for that specific event enables the several contestants to get a feel for the reality of the event as it actually occurs. Again, the length of the jump or throw is determined by the random number generator.

Going now jointly to FIGS. 1, 2 and 7, the spinner is shown as having a post 30 which mounts in a mating hole there below. The hole 80 can be formed in the transparent material defining the cabinet shown FIG. 1 of the drawings. In addition to that, where the inserts are relatively thin, the inserts are preferably formed with a small opening exemplified in FIG. 7 and an upstanding alignment hub is positioned in the hole in the insert. As shown in detail in FIG. 7, a base plate 93 support and upstanding cup 94. The spinner shown in FIG. 2 of the drawings is positioned in the sleeve or cup 94 and is aligned thereat. The base 93 assures that the spinner is held for rotation about a vertical axis. A single insert 22 is shown in FIG. 7 of the drawings where the insert thickness has been exaggerated. This particular embodiment enables the spinner to be anchored against or with respect to a single insert. Even where the insert is thin, there is sufficient lateral support to the hub of the spinner or pivot.

RULES OF PLAY

Specific rules of play have not been set out. As a generalization, the rules of play that find most favor are rules which provide every player with a turn in attempting to advance their marker. As noted, the game accommodates up to about 8 players. As further noted, the 8 players each advance along a game playing path. Examples of the game playing path were given in FIGS. 3 and 4.

During play, it may happen that players arrive at the finish line after an equal number of moves. In that instance, it may be desirable to have a tie breaking arrangement. Referring to the spinner shown in FIG. 1 of the drawings, the spinner is rotated to obtain the moves which are measured by fixed units of length. If need be, the spinner at 14 can be provided with a second set circle of calibrations which can be smaller or larger than the circle of calibrations shown in FIG. 1 of the drawings. If desired, second, third and fourth circles around the spinner can be defined as circles, and they can be calibrated to different measurements. As an example, they can be calibrated in metric units of measure. This enable the players to create a random number representative of their actual performance. A bigger number will typically correspond to a longer jump or faster time. Without regard to specific rules of play, the rules of play can be changed or modified to accommodate game play as generally described herein.

Figure 11:
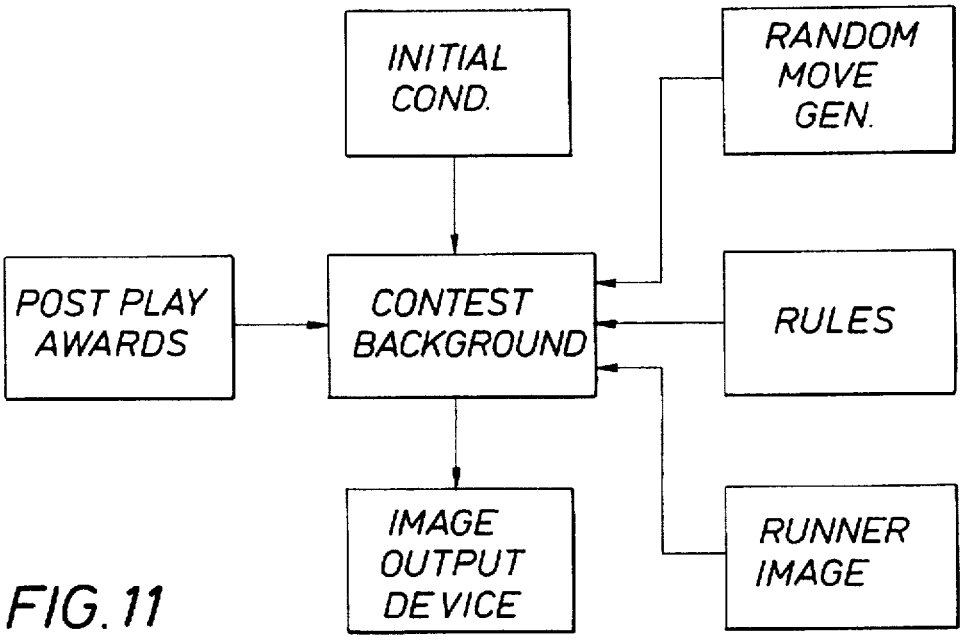
FIG. 11 is a block diagram of a program for the game.

Attention is now directed to FIG. 11 of the apparatus which shows another version. In this particular instance, the version is provided in the form of a CD ROM. The CD ROM stores in memory an image which includes the background of the contest. This is the setting or context such as the oval track, the swimming pool, and more particularly, a track or pool with several racing lanes. Again, the number can be indefinite but it is preferable to include eight racing lanes for both the oval and pool because this corresponds more accurately to typical sporting events and especially those that are carried out at the Olympics. In addition to that, the software package depicted in FIG. 11 includes a set of initial conditions. The initial conditions relate to the length of the race. For instance, for a single track oval, there are many races that can be run on it. The races include the 100, 200, 400, etc. meter races, both for individuals and relay teams. Therefore, the background is provided and the initial conditions enables selection of the type of race to be run on the particular background. Lane assignments are made for individual contestants ranging from two and up to the capacity of the oval or pool. Again, that preferably is between two and eight. Not only are lane assignments made, the rules of the race are also loaded or implemented. In that particular instance, the role of the dice is converted into a scale factor. As noted above, the scale typically is altered by loading the advance or move of an individual contestant depending on the length of the race. Quite obviously, there is a tremendous difference in scale between the 10,000 meter run compared with the 200 meter run. In accordance with FIG. 11, the CD ROM software package includes a set of runner images. By that, a particular image is selected and presented for a particular contestant. The runner image (or swimmer for that matter) includes selection of the runner, appearance and uniform. The contestant can select the runner image including variables such as sex of the contestant, color of the contestant, and color of the uniform. With regard to the latter, national uniforms can be selected as desired. This can be tied to the flag of the countries involved in the Olympics to pick an example. This data is input before a particular contest. This enables the CD ROM software package to provide an image output. This is typically presented on a screen.

FIG. 11 additionally shows a random move generator. This corresponds to the random number generator which is obtained either by rotating the spinner previously disclosed, rolling the dice, or other random number generators. In this particular instance, it can be readily mechanized in an alternate fashion as for instance by providing a prompt to a particular contestant that the next "spin" is that of the particular contestant, and providing an image on a screen enabling the screen to be touched. The image on the screen is touched by that contestant, and a number is then presented on the screen momentarily. Then, the screen reverts to the contest background showing the particular swimmer or runner of that contestant on the screen and advancing that runner in accordance with the move indicated by the random number generator. This can be executed by the several contestants who will see their particular images competing in the contest background. Since they run in separate lanes, they can be presented individually and yet as a group to show relative placement among the contestants in the group as they run the race, swim the pool, etc. Award ceremonies can be shown.

While the foregoing is directed to the preferred embodiment, the scope thereof is determined by the claims which follow.

I claim:

1. A board game comprising:

(a) a top face of transparent material of specified length and width and having an exposed play area;

(b) a storage compartment below said top face wherein said compartment is defined by a pair of parallel sides extending along said top face to a defined depth;

(c) side located insert storage shoulders internally along said sides having aligned positions forming shelves;

(d) at least a pair of inserts positioned in a stored position on said shoulders wherein one insert has a game image visible through said top face when positioned adjacent to said top face;

(e) wherein said shoulders position one insert visible through said top face and position a second insert parallel to and below said one insert;

(f) a door selectively opening and closing to enable access to said storage compartment wherein said door enables insert rein_oval and replacement therein;

(g) a spinner pivoted on a post aligned in a passage in said top face and wherein the insert visible through said top face has a set of spinner related marks on said insert directing game play, and said insert is positioned in operative position with respect to said spinner;

(h) a marker for game play having a base supporting said marker on said top face and said marker is positioned with respect to a game image visible through said top face from said insert.

2. The apparatus of claim 1 wherein said top face is a rectangle, and said pair of parallel sides connects with a third side to define said storage compartment, and wherein said storage compartment includes said shoulders defining a pair of facing shoulders and a second pair of facing shoulders therebelow so that said first and second inserts are rested thereon and are captured thereon on closure of said door; and said inserts incorporate different sets of spinner related marks thereon.

3. The apparatus of claim 2 wherein said spinner rotates in a circle on said top face and is supported by said pivot post extending through a passage through said top face, and wherein said insert positions said spinner related marks in the form of a circle including numbers having a value up to N and N is a whole number integer.

4. The apparatus of claim 3 wherein said insert is constructed with laminated impervious surface material on the top thereof covering over an image visible through said surface lamination and further comprises a supportive, magnetically attracted ferrous layer therein.

5. The apparatus of claim 4 wherein said insert is a laminated sheet of opaque material having a planar image layer visible on the top face thereof and said image layer is covered by a planar laminated impervious layer.

6. The apparatus of claim 5 wherein said insert has two faces with an image on each of said two faces and an impervious protective laminate layer thereover.

7. The apparatus of claim 2 wherein said spinner and post are demountable for storage in said compartment when not installed on said top face by positioning said spinner on said post and positioning said post in said passage extending into and through said top face.

8. The apparatus of claim 1 wherein said pair of parallel sides terminates at a third side, and said door forms a fourth side to define said compartment therein, and including a handle on one of said sides for user support at the handle.

9. The apparatus of claim 1 wherein said storage compartment is defined by said pair of sides and two additional sides at right angles thereto defining a rectangular storage compartment, and wherein said door is located in one of said sides, and further including a second door in said one side wherein both of said doors are held closed by door latches.

10. The apparatus of claim 9 wherein said insert comprises a removable sheet member having a peripheral edge therearound sized to fit below, parallel to and adjacent to said top face and said top face is constructed above and parallel to a slot below said top face and above said first shoulders for receiving said insert thereon.

11. The apparatus of claim 1 wherein said top face comprises a rectangle and said top face connects to left and right sides extending downwardly to a bottom side parallel to and spaced below said top face to define said storage compartment, and said door is located between said top face and bottom side.

12. The apparatus of claim 1 wherein said insert comprises a magnetically attracted material integral with said insert, and said market includes a magnet to enable attraction to said magnetic material.

13. The apparatus of claim 1 wherein (a) said compartment and said shelves therein are rectangular to receive said inserts;

(b) said compartment is closed by said door;

(c) said door is closed by a latch;

(d) said top face and compartment comprise a carrying case supported by a handle.

14. The apparatus of claim 13 wherein said compartment is accessed through said door and a second door.

15. The apparatus of claim 13 wherein said door mounts on a hinge along an edge thereof.

16. The apparatus of claim 1 wherein said spinner comprises a pointer having a post engaging means on the lower side thereof.

17. The apparatus of claim 16 wherein said post insert fully through said top face.

18. The apparatus of claim 16 wherein said marks are arranged in a circle around said post on said insert.

19. A board game comprising:

(a) a top face of transparent material of specified length and width and having an exposed play area;

(b) a storage compartment below said top face wherein said compartment is defined by a pair of parallel sides extending along said top face to a defined depth;

(c) side located insert storage shoulders internally along said sides having aligned positions forming shelves;

(d) at least a pair of inserts positioned in a stored position on said shoulders wherein one insert has a game image visible through said top face when positioned adjacent to said top face;

(e) wherein said shoulders position one insert visible through said top face and position a second insert parallel to and below said one insert;

(f) a spinner pivoted on a post aligned in a passage in said top face and wherein the insert visible through said top face has a set of spinner related marks on said insert directing game play, and said insert is positioned in operative position with respect to said spinner;

(g) a marker for game play having a base supporting said marker on said top face and said marker is positioned with respect to a game image visible through said top face from said insert.

20. The apparatus of claim 19 wherein said spinner and post are demountable to store in said compartment and are positioned on said top face for game play.

21. The apparatus of claim 20 wherein said compartment stores said inserts and spinner therein and functions as a carrying case for said game.

22. The apparatus of claim 19 wherein said compartment stores a tray therein for small game parts.

23. The apparatus of claim 19 wherein said inserts present different games and are arranged in a specified and numbered sequence.

* * * * *